US009915898B2

(12) United States Patent
Otsuka et al.

(10) Patent No.: US 9,915,898 B2
(45) Date of Patent: Mar. 13, 2018

(54) IMAGE FORMING APPARATUS, CONTROL METHOD, AND NON-TRANSITORY STORAGE MEDIUM FOR EFFICIENTLY REDUCING OPERATIONAL START TIME

(71) Applicant: Konica Minolta, Inc., Chiyoda-ku, Tokyo (JP)

(72) Inventors: Yutaka Otsuka, Toyokawa (JP); Masashi Saito, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/213,683

(22) Filed: Jul. 19, 2016

(65) Prior Publication Data

US 2017/0023891 A1 Jan. 26, 2017

(30) Foreign Application Priority Data

Jul. 21, 2015 (JP) ..... 2015-143959

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/70
See application file for complete search history.

(56) References Cited

U.S. PATENT DOCUMENTS

2005/0191076 A1 9/2005 Dan
2012/0114355 A1* 5/2012 Amemiya ..... G03G 15/2025 399/67
2012/0294640 A1 11/2012 Arakawa

FOREIGN PATENT DOCUMENTS

JP 5-127565 A 5/1993
JP 05-289574 A 11/1993
JP H06-161323 A 6/1994
(Continued)

OTHER PUBLICATIONS

Office Action (Notice of Grounds of Rejection) dated Aug. 8, 2017, by the Japanese Patent Office in corresponding Japanese Patent Application No. 2015-143959, and an English Translation of the Office Action. (14 pages),
(Continued)

*Primary Examiner* — Billy Lactaoen
(74) *Attorney, Agent, or Firm* — Buchanan Ingersoll & Rooney PC

(57) ABSTRACT

An image forming apparatus has an operating state and a non-operating state with power consumption smaller than in the operating state. The image forming apparatus includes: a fixing device for thermally fixing a toner image on a print material; an execution unit for executing warm-up to heat the fixing device up to a printable temperature for fixing the toner image on the print material, upon power-on or in shifting from the non-operating state to the operating state; and a temperature control unit for maintaining a waiting state to keep the fixing device at the printable temperature or higher, after completion of warm-up or printing. The temperature control unit increases the temperature of the fixing device higher in a waiting state after printing a predetermined number of times since power-on or in a waiting state after the non-operating state for a predetermined time or longer, than in any other waiting state.

15 Claims, 9 Drawing Sheets

(56) References Cited

FOREIGN PATENT DOCUMENTS

| | | | |
|---|---|---|---|
| JP | 2005-249871 | A | 9/2005 |
| JP | 2012-242635 | A | 12/2012 |

OTHER PUBLICATIONS

Office Action (Notice of Grounds of Rejection) dated Jan. 16, 2018 by the Japanese Patent Office in corresponding Japanese Patent Application No. 2015-143959 and English translation of the Office Action (8 pages).

* cited by examiner

IMAGE FORMING APPARATUS, CONTROL METHOD, AND NON-TRANSITORY STORAGE MEDIUM FOR EFFICIENTLY REDUCING OPERATIONAL START TIME

This application is based on Japanese Patent Application No. 2015-143959 filed with the Japan Patent Office on Jul. 21, 2015, the entire content of which is hereby incorporated by reference.

BACKGROUND OF THE INVENTION

Field of the Invention

The present disclosure relates to control of an image forming apparatus, and more particularly to control of the fixing device included in an image forming apparatus.

Description of the Related Art

Electrophotographic image forming apparatuses are commonly used. An electrophotographic image forming apparatus includes a fixing device. The fixing device includes a rotatable heating unit and a rotatable pressing unit pressed against the heating unit. The image forming apparatus heats the heating unit to fuse a toner image on a print material passing through between the heating unit and the pressing unit and fixes the toner image on the print material.

In connection with control of a fixing device, Japanese Laid-Open Patent Publication No. 2012-242635 discloses an image forming apparatus in which "the surface temperature of the heating member can be maintained in STANDBY mode within a range of setting temperatures without causing temperature overshoot or undershoot". Japanese Laid-Open Patent Publication No. 05-289574 discloses a fixing device in which "the surface temperature of the fixing roller can be maintained to a predetermined control temperature stably and accurately without damaging the roller".

When being powered on or when accepting a print instruction, an image forming apparatus executes a warm-up for heating the heating unit up to a printable temperature and executes a print process after completion of the warm-up lithe warm-up takes time, the waiting time for the user in printing becomes long. An image forming apparatus capable of reducing the time taken for a warm-up is thus desired.

The image forming apparatus disclosed in Japanese Laid-Open Patent Publication No. 2012-242635 is aimed to stably maintain the surface temperature of the heating member within a predetermined range. That is, the image forming apparatus is not intended to reduce the time taken for a warm-up.

The fixing device disclosed in Japanese Laid-Open Patent Publication No. 05-289574 is aimed to stably maintain the surface temperature of the fixing roller within a predetermined range. That is, the fixing device is not intended to reduce the time taken for a warm-up, either.

SUMMARY OF THE INVENTION

An object of the present disclosure according to an aspect is to provide an image forming apparatus capable of reducing the waiting time for the user in printing. An object according to another aspect is to provide a control method capable of reducing the waiting time for the user in printing. An object according to yet another aspect is to provide a control program capable of reducing the waiting time for the user in printing.

According to an aspect, an image forming apparatus is provided, which has an operating state and a non-operating state with power consumption smaller than power consumption in the operating state. The image forming apparatus includes a fixing device including a rotatable heating unit and a rotatable pressing unit pressed against the heating unit. The fixing device fixes a toner image on a print material passing through between the heating unit and the pressing unit by heating the heating unit. The image forming apparatus includes an execution unit for executing a warm-up to heat the heating unit up to a predetermined temperature that allows the toner image to be fixed on the print material, when the image forming apparatus is powered on or when the image forming apparatus shifts from the non-operating state to the operating state, and a temperature control unit for maintaining a waiting state after completion of the warm-up or after completion of printing. The temperature control unit executes a process of increasing a temperature of the heating unit higher in a waiting state after printing is executed a predetermined number of times since the image forming apparatus is powered on or in a waiting state after the non-operating state continues for a predetermined time or longer, than in any other waiting state.

Preferably, the predetermined number of times is one.

Preferably, the fixing device includes a sensor for detecting a temperature of the heating unit. The temperature control unit does not execute the process when a temperature of the heating unit at start of the warm-up is a predetermined, temperature or higher.

Preferably, the temperature control unit adjusts a temperature of the heating unit by changing at least one of a target temperature set for the heating unit and a rotation time of the heating unit.

Preferably, the temperature control unit sets the target temperature to a first temperature and sets the rotation time to a first time, in the waiting state after printing is executed the predetermined number of times or in the waiting state after the non-operating state continues for the predetermined time or longer. The temperature control unit sets the target temperature to a second temperature lower than the first temperature and sets the rotation time to a second time shorter than the first time, in the other waiting state.

Preferably, the temperature control unit stops the process when a print instruction is accepted during execution of the process.

According to another aspect, a control method for an image forming apparatus is provided. The image forming apparatus has an operating state and a non-operating state with power consumption smaller than power consumption in the operating state. The image forming apparatus includes a fixing device including a rotatable heating unit and a rotatable pressing unit pressed against the heating unit. The fixing device fixes a toner image on a print material passing through between the heating unit and the pressing unit by heating the heating unit. The control method includes: executing a warm-up to heat the heating unit up to a predetermined temperature that allows the toner image to be fixed on the print material, when the image forming apparatus is powered on or when the image forming apparatus shifts from the non-operating state to the operating state; and maintaining a waiting state after completion of the warm-up or after completion of printing. The maintaining includes executing a process of increasing a temperature of the heating unit higher in a waiting state after printing is executed a predetermined number of times since the image forming apparatus is powered on or in a waiting state after the non-operating state continues for a predetermined time or longer, than in any other waiting state.

According to a further aspect, a non-transitory storage medium encoded with a control program for an image forming apparatus is provided. The image forming apparatus has an operating state and a non-operating state with power consumption smaller than power consumption in the operating state. The image forming apparatus includes a fixing device including a rotatable heating unit and a rotatable pressing unit pressed against the heating unit. The fixing device fixes a toner image on a print material passing through between the heating unit and the pressing unit by heating the heating unit. The control program causes the image forming apparatus to execute: executing a warm-up to heat the heating unit up to a predetermined temperature that allows the toner image to be fixed on the print material, when the image forming apparatus is powered on or when the image forming apparatus shifts from the non-operating state to the operating state; and maintaining a waiting state after completion of the warm-up or after completion of printing. The maintaining includes executing a process of increasing a temperature of the heating unit higher in a waiting state after printing is executed a predetermined number of times since the image forming apparatus is powered on or in a waiting state after the non-operating state continues for a predetermined time or longer, than in any other waiting state.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described below with reference to the drawings. In the following description, the same parts and components are denoted with the same reference signs. Their names and functions are also the same, and a detailed description thereof will not be repeated. Embodiments and modifications described below may be selectively combined as appropriate.

[Image Forming Apparatus 100]

Figure 1:
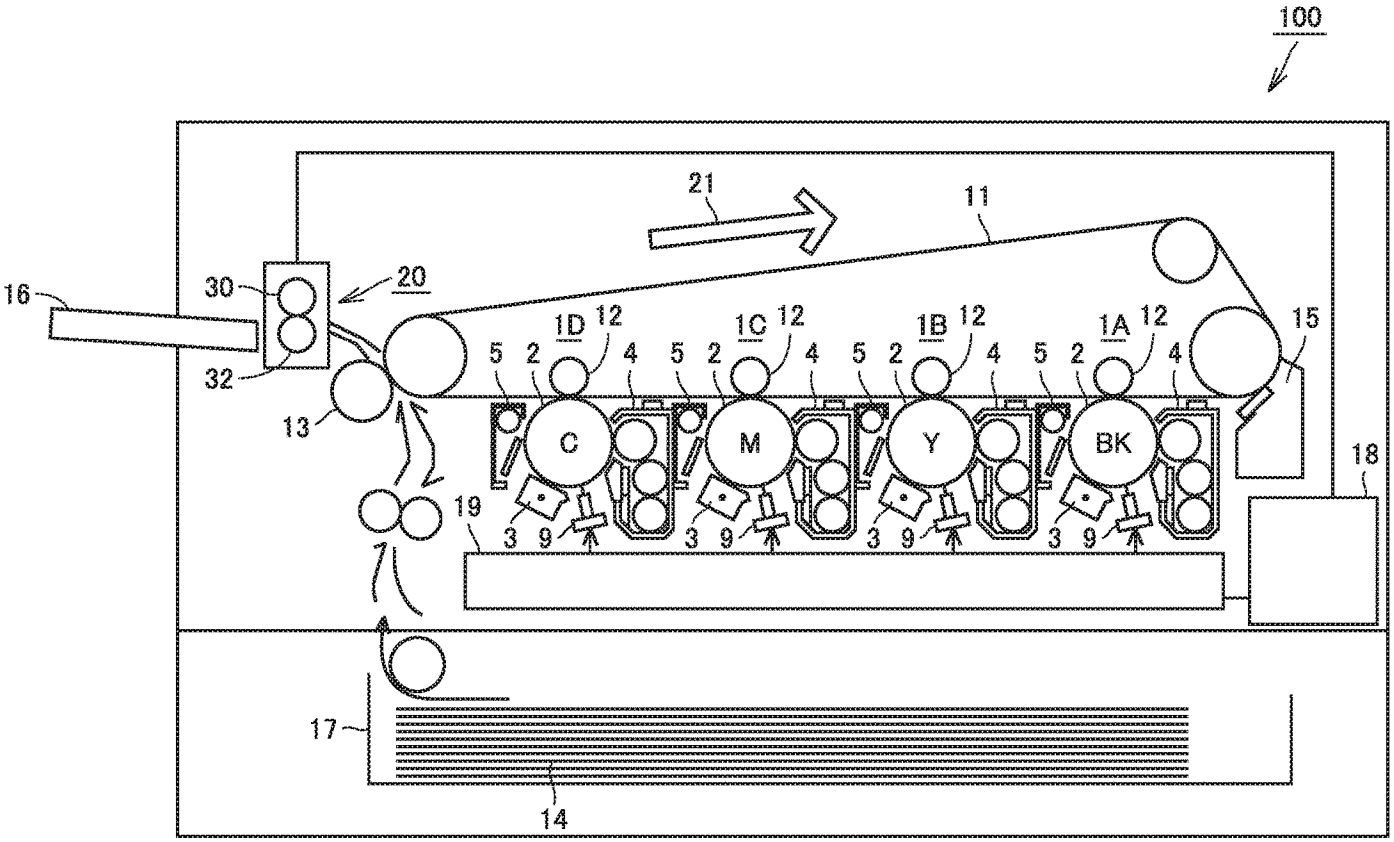
FIG. 1 is a diagram showing an exemplary apparatus configuration of an image forming apparatus according to an embodiment.

Referring to FIG. 1, an image forming apparatus 100 according to an embodiment will be described. FIG. 1 is a diagram showing an exemplary apparatus configuration of image forming apparatus 100.

FIG. 1 shows image forming apparatus 100 as a color printer. Although image forming apparatus 100 as a color printer will be described below, image forming apparatus 100 is not limited to a color printer. For example, image forming apparatus 100 may be a monochrome printer or a multi-functional peripheral (MFP) which is a combination of a monochrome printer or a color printer and a facsimile.

Image forming apparatus 100 includes image forming units 1A to 1D, an intermediate transfer belt 11, primary transfer units 12, a secondary transfer unit 13, a cleaning unit 15, a tray 16, a cassette 17, a control device 18, an exposure control unit 19, and a fixing device 20.

Image forming unit 1A forms a black (BK) toner image. Image forming unit 1B forms a yellow (Y) toner image. Image forming unit 1C forms a magenta (M) toner image, image forming unit 11) forms a cyan (C) toner image. Intermediate transfer belt 11 rotates in the direction of arrow 21. Image forming units 1A to 1D are arranged in order along the direction in which intermediate transfer belt 11 rotates.

Image forming units 1A to 1D each include a photoconductor 2, a charging unit 3, a development unit 4, a cleaning unit 5, and an exposure unit 9.

Photoconductor 2 is an image carrier that carries a toner image thereon. Photoconductor 2 is, for example, a photoconductor drum having a photosensitive layer on its surface. Photoconductor 2 rotates in the direction corresponding to the direction in which intermediate transfer belt 11 rotates.

Charging unit 3 uniformly charges the surface of photoconductor 2. Exposure unit 9 emits laser to photoconductor 2 in response to a control signal from exposure control unit 19 and exposes the surface of photoconductor 2 in accordance with the specified image pattern. An electrostatic latent image corresponding to an input image is thus formed on photoconductor 2.

Development unit 4 develops the electrostatic latent image formed on photoconductor 2 as a toner image. As an example, development unit 4 develops the electrostatic latent image using a developer including toner and carrier.

Photoconductor 2 and intermediate transfer belt 11 are in contact with each other at the position where primary transfer unit 12 is provided. A predetermined transfer bias is applied to this contact section, and this transfer bias causes the toner image on photoconductor 2 to be transferred onto intermediate transfer belt 11. Here, a black (BK) toner image, a yellow (Y) toner image, a magenta (M) toner image, and a cyan (C) toner image are successively superimposed to be transferred onto intermediate transfer belt 11. A color toner image is thus formed on intermediate transfer belt 11.

Cleaning unit 5 includes a cleaning blade. The cleaning blade is pressed against photoconductor 2 to recover toner left on the surface of photoconductor 2 after the toner image is transferred.

Cassette 17 is provided at the bottom of image forming apparatus 100A print material 14 such as paper is set in cassette 17. Print material 14 is sent one by one from cassette 17 to secondary transfer unit 13. The timing of feeding and conveying print material 14 is synchronized with the position of the toner image on intermediate transfer belt 11, so that the toner image is transferred to the appropriate position on print material 14. Print material 14 is then sent to fixing device 20.

Fixing device 20 includes a rotatable heating unit 30 and a pressing roller 32 (pressing unit) pressed against heating unit 30. Fixing device 20 fuses toner on print material 14 passing through between heating unit 30 and pressing roller 32 by heating heating unit 30 and fixes the toner image on print material 14. Print material 14 is then discharged to tray 16.

Cleaning unit 15 includes a cleaning blade. The cleaning blade is pressed against intermediate transfer belt 11 to recover toner left on intermediate transfer belt 11 after the toner image is transferred. The toner is conveyed by a conveyance screw (not shown) and collected in a waste toner container (not shown).

Control device 18 controls image forming apparatus 100. Control device 18 controls, for example, exposure control unit 19 and fixing device 20. Control device 18 controls, for example, a motor (not shown) provided in heating unit 30 to adjust the rotation speed, the rotation time, and the like of heating unit 30. The motor is controlled, for example, by PWM (Pulse Width Modulation).

[Control of Fixing Device 20]

Figure 2A:
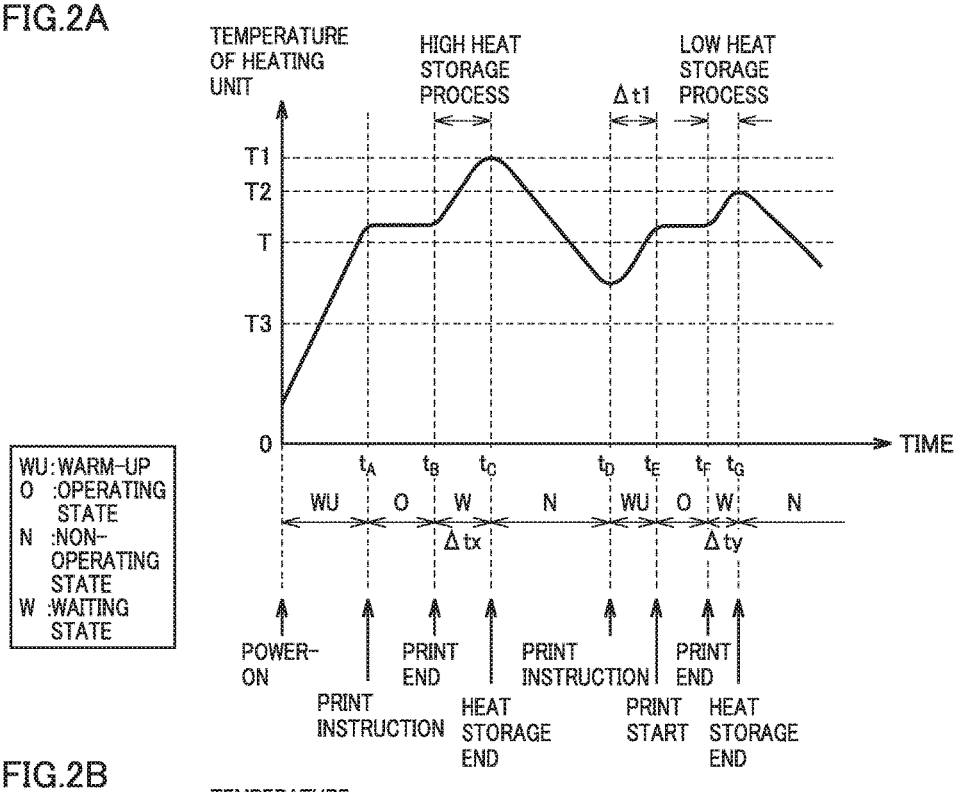
FIG. 2A and FIG. 2B are diagrams showing the relation between the states of the image forming apparatus according to an embodiment and the temperatures of the heating unit.
Figure 2B:
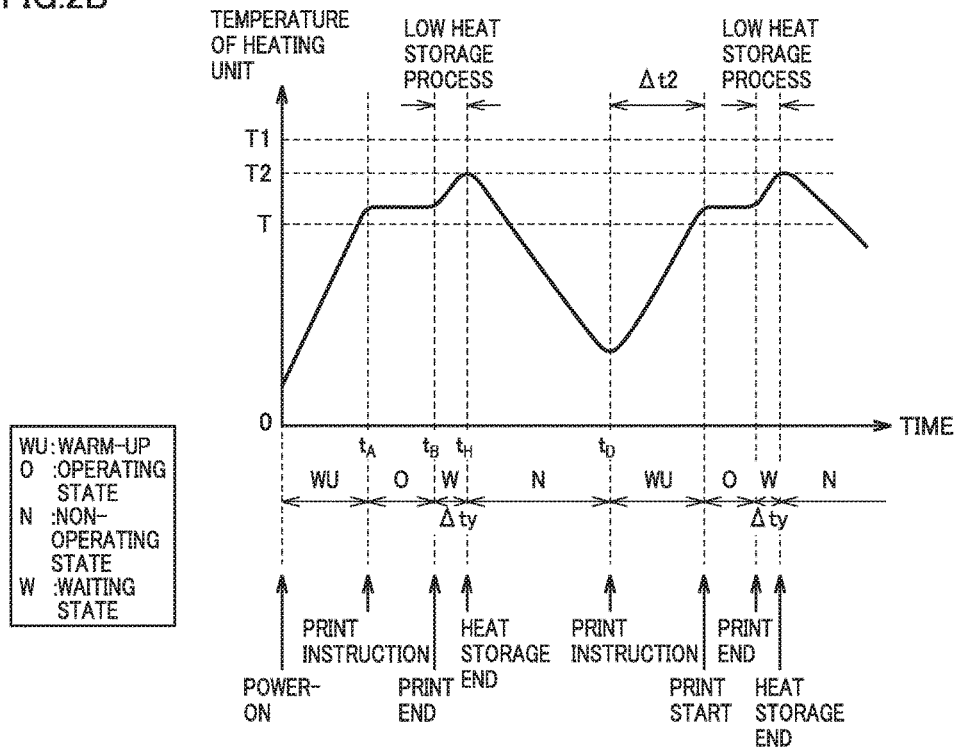

Referring to FIG. 2A and FIG. 2B, temperature control for fixing device 20 (see FIG. 1) by control device 18 (see FIG. 1) will be described. FIG. 2A and FIG. 2B are diagrams showing the relation between the states of image forming apparatus 100 and the temperatures of heating unit 30 (see FIG. 1).

Image forming apparatus 100 has states including an operating state, a non-operating state, a warm-up state, and a waiting state. The "operating state" refers to a state in which image forming apparatus 100 is in operation, for example, in response to a print instruction. The "non-operating state" refers to a state in which image forming apparatus 100 is in operation with power consumption smaller than in the operating state. The non-operating state includes, for example, a sleep state in which image forming apparatus 100 is kept in a low-power state. The "warm-up state" refers to a state in which heating unit 30 is heated up to a printable temperature. The "waiting state" refers to a state in which, for example, a print instruction is awaited. The waiting state includes, for example, a standby state.

As shown in FIG. 2A, image forming apparatus 100 starts a warm-up based on power-on and increases the temperature of heating unit 30 higher than a printable temperature T.

Assume that image forming apparatus 100 accepts a print instruction at time $t_A$. When the temperature of heating unit 30 exceeds printable temperature T, image forming apparatus 100 terminates the warm-up and shifts from the warm-up state to the operating state to start a print process.

Assume that the print process terminates at time $t_B$. Image forming apparatus 100 shifts from the operating state to the waiting state based on the termination of the print process. At this point of time, image forming apparatus 100 stores heat in heating unit 30 as a preparation for the next printing. The heat storage process is implemented, for example, by idling heating unit 30 and pressing roller 32. During the waiting state between times $t_B$ and $t_C$, more heat is stored than during any other waiting state. As an example, image forming apparatus 100 heats heating unit 30 up to a target temperature T1. The process of storing heat up to target temperature T1 hereinafter may be referred to as "high heat storage process", and the process of storing heat up to a target temperature T2 lower than target temperature T1 may be referred to as "low heat storage process".

Image forming apparatus 100 adjusts the temperature of heating unit 30 by changing at least one of the target temperature set for fixing device 20 and the rotation time of heating unit 30.

In an aspect, during a high heat storage process, image forming apparatus 100 sets the target temperature to temperature T1 (first temperature). During a low heat storage process, image forming apparatus 100 sets the target temperature to temperature T2 (second temperature) lower than temperature T1. Temperatures T1, T2 may be preset during the design of image forming apparatus 100 or may be set as desired by the user of image forming apparatus 100.

In another aspect, during a high heat storage process, image forming apparatus 100 sets the rotation time of heating unit 30 to a time $\Delta t_x$ (first time). Time $\Delta t_x$ is, for example, 900 seconds. During a low heat storage process, image forming apparatus 100 sets the rotation time of heating unit 30 to a time $\Delta t_y$ (second time) shorter than time $\Delta t_x$. Time $\Delta t_y$ is, for example, 5 seconds. Times $\Delta t_x$, $\Delta t_y$ may be preset during the design of image forming apparatus 100 or may be set as desired by the user of image forming apparatus 100.

At time $t_C$ when time $\Delta t_x$ has elapsed since time $t_B$ when printing was finished, image forming apparatus 100 shifts from the waiting state to the non-operating state. Time $\Delta t_x$ may be preset or may be set as desired by the user of image forming apparatus 100 through the operation panel. During the non-operating state, the temperature of heating unit 30 gradually decreases due to heat dissipation.

Assume that at time $t_D$, image forming apparatus 100 accepts a new print instruction. Based on this, image forming apparatus 100 starts a warm-up and increases the temperature of heating unit 30 higher than printable temperature T.

When the temperature of heating unit 30 exceeds the printable temperature at time $t_E$, image forming apparatus 100 terminates the warm-up and shifts to the operating state to start printing.

Assume that the print process is finished at time $t_F$. Based on this, image forming apparatus 100 shifts from the operating state to the waiting state. In the present waiting state, image forming apparatus 100 performs a low heat storage process. At time $t_C$, when a predetermined time has elapsed since time $t_F$, image forming apparatus 100 shifts from the waiting state to the non-operating state.

The effect of executing a high heat storage process during the waiting state between times $t_B$ and $t_C$ will be described by comparing FIG. 2A and FIG. 2B.

As shown in graph (A), a high heat storage process is executed in the waiting state between times $t_B$ and $t_C$ to reduce time $\Delta t1$ required for the next warm-up. On the other hand, as shown in graph (B), when a low heat storage process is executed in the waiting state between times $t_B$ and $t_H$, time $\Delta t2$ required for the next warm-up is increased. That is, image forming apparatus 100 can reduce the time required for the next warm-up from time $\Delta t2$ to time $\Delta t1$ by executing a high heat storage process. As a result, a printing time is reduced to improve the users' convenience.

The execution of a high heat storage process is particularly effective in a situation in which print instructions do not frequently occur. This is because increasing the amount of heat storage in such a situation prevents heating unit 30 from cooling off until the next printing even when the non-operating state continues for a long time. On the other hand, when print instructions frequently occur, the next printing is done before heating unit 30 of fixing device 20 cools down, and a printing time does not take so long even without a high heat storage process.

Examples of the situation in which print instructions do not frequently occur include the condition of use early in the morning. In a typical condition of use early in the morning, a user turns on the power to do some prints. Early in the morning, image forming apparatus 100 is used by fewer users and therefore image forming apparatus 100 is in the non-operating state for a long time (for example, one hour) since printing.

In order to determine such a situation in which the frequency of use is low, image forming apparatus 100 determines whether the waiting state is subsequent to execution of printing a predetermined number of times since power-on. Alternatively, image forming apparatus 100 determines whether the waiting state is subsequent to the non-operating state kept for a predetermined time (for example, two hours) or longer. When it is determined that the waiting state is in a situation in which the frequency of use is low, image forming apparatus 100 increases the temperature of heating unit 30 higher than in any other waiting state. This reduces a printing time under the situation in which the frequency of use is low.

After a while since power-on, the number of users gradually increases, and, for example, image forming apparatus 100 repeats printing for 30 seconds or so and a sleep state for 15 minutes or so. In such a situation in, which the frequency of use is high, the next printing is executed before heating unit 30 cools down. Image forming apparatus 100 thus executes a low heat storage process. Alternatively, image forming apparatus 100 does not execute a heat storage process per se. Image forming apparatus 100 thus need not store extra heat in heating unit 30 thereby minimizing power consumption of fixing device 20 and prolonging the service life of fixing device 20.

Preferably, image forming apparatus 100 executes a high heat storage process in the waiting state after the first printing since power-on. Image forming apparatus 100 executes a low heat storage process in the waiting state after the second and subsequent printing. A high heat storage process is executed only in the waiting state after the first printing, thereby reducing the time required for the second print process.

When the frequency of use of image forming apparatus 100 is low, the temperature of heating unit 30 is likely to be low, in this regard image forming apparatus 100 may further use the temperature of heating unit 30 at the start of a warm-up, as a criterion for determining whether the frequency of use is low. More specific processing is as follows. Image forming apparatus 100 acquires the temperature of heating unit 30 from thermistors 36A, 36B described later based on the start of a warm-up. When the temperature of heating unit 30 at the start of a warm-up is equal to or higher than a predetermined temperature 13 (for example, 50° C.; or higher), a high heat storage process is not executed. That is, image forming apparatus 100 executes a high heat storage process only when the temperature of heating unit 30 at the start of a warm-up is lower than predetermined temperature T3. This ensures that image forming apparatus 100 determines a situation in which the frequency of use is low.

In FIG. 2A and FIG. 2B, image forming apparatus 100 executes a heat storage process in two levels: a high heat storage process and a low heat storage process. However, image forming apparatus 100 may execute a heat storage process in three or more levels. For example, in view of correlation of cooling of fixing device 20 with the non-operating time, image forming apparatus 100 may determine the target temperature of a heat storage process in accordance with the length of the non-operating time of a past in an aspect, image forming apparatus 100 sets a lower target temperature in the waiting state as the time since power-on is longer, in another aspect, image forming apparatus 100 sets a higher target temperature as the previous non-operating time is longer, and image forming apparatus 100 sets a lower target temperature as the previous non-operating time is shorter.

[Stopping of High Heat Storage Process]

Figure 3:
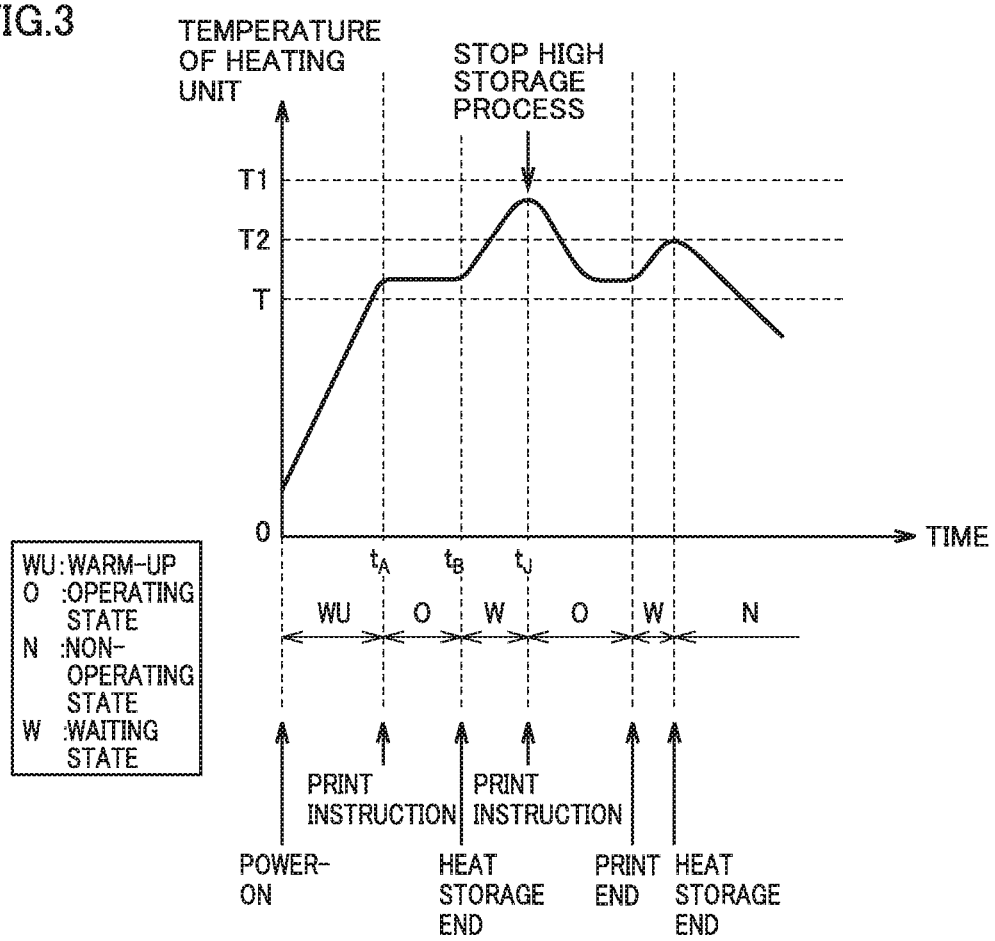
FIG. 3 is a diagram showing the changing temperatures of the heating unit when the process of stopping a high heat storage process is executed.

Referring to FIG. 3, the process of stopping a high heat storage process will now be described. FIG. 3 is a diagram showing temperature changes of heating unit 30 (see FIG. 1) when the process of stopping a high heat storage process is executed.

When a print process is accepted during execution of a high heat storage process, image forming apparatus 100 stops the high heat storage process. For example, as shown in FIG. 3, assume that image forming apparatus 100 starts a high heat storage process at time $t_B$ and accepts a print instruction at time $t_J$ during the high heat storage process. In this case, image forming apparatus 100 stops the high heat storage process even when the temperature of heating unit 30 does not reach target temperature T1.

Image forming apparatus 100 thus can stop a high heat storage process when print instructions occur exceptionally frequently, even though it has been determined that the frequency of use is low. This processing prevents image forming apparatus 100 from storing excessive heat in heating unit 30.

[Functional Configuration of Image Forming Apparatus 100]

Figure 4:
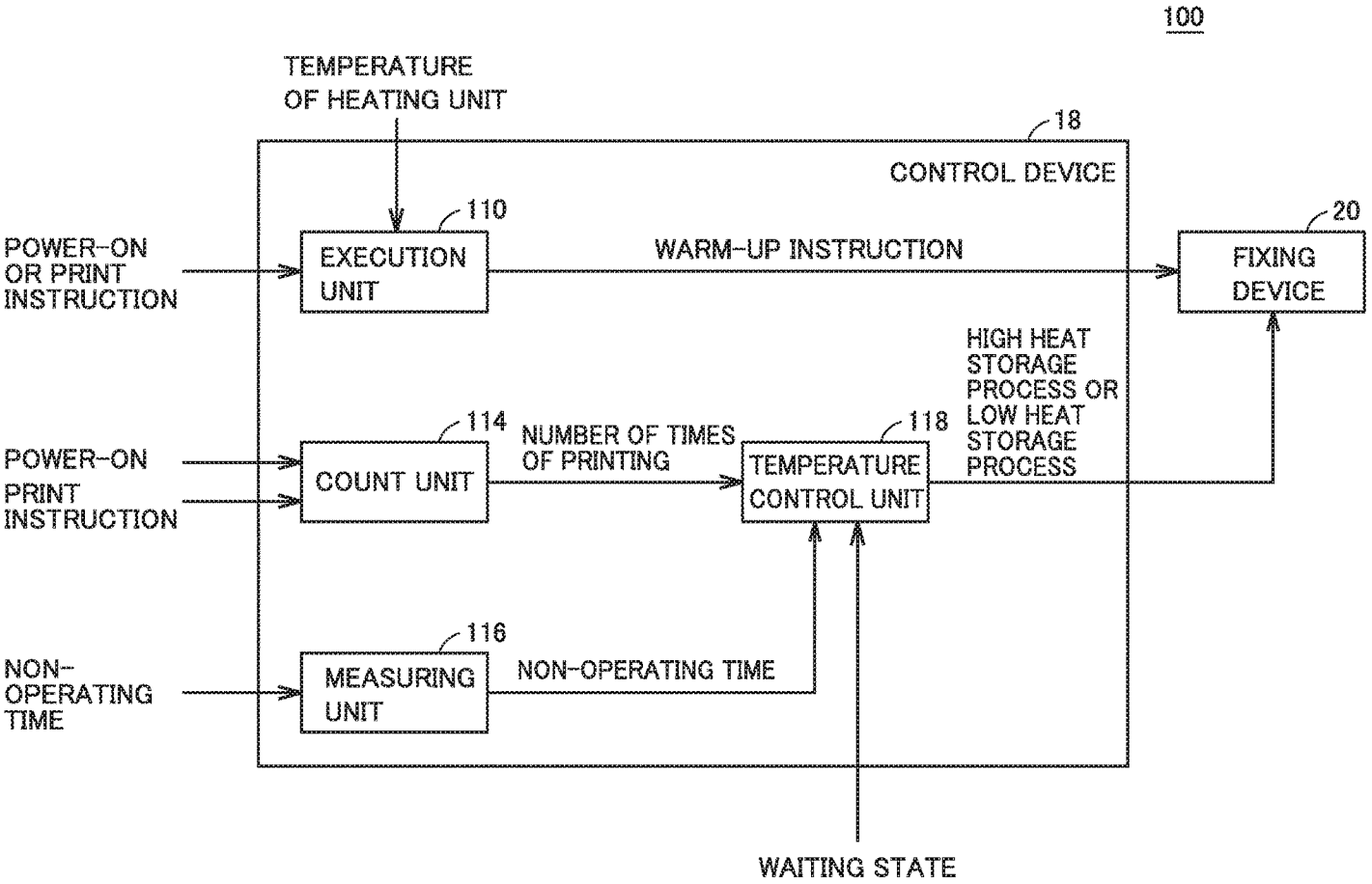
FIG. 4 is a block diagram showing an exemplary functional configuration of the image forming apparatus according to an embodiment.

Referring to FIG. 4, the functions of image forming apparatus 100 will be described. FIG. 4 is a block diagram showing an exemplary functional configuration of image forming apparatus 100.

As shown in FIG. 4, image forming apparatus 100 includes control device 18 and fixing device 20. Control device 18 includes, as a functional configuration, an execution unit 110, a count unit 114, a measuring unit 116, and a temperature control unit 118.

Execution unit 110 executes a warm-up of fixing device 20. As an example, a warm-up is executed when image forming apparatus 100 is powered on. Alternatively, a warm-up is executed when image forming apparatus 100 accepts a print instruction and returns to the operating state from the non-operating state. Otherwise, a warm-up is executed, for example, during a power reset, during recovery from a jam, or during closing of the cover.

Count unit 114 counts the number of times of printing since image forming apparatus 100 is powered on. For example, count unit 114 clears the number of times of printing based on power-on, and counts up the number of times of printing every time a print instruction is accepted. One print instruction is equivalent to one print job. One or more sheets may be printed per print instruction. Count unit 114 outputs the counted number of times of printing to temperature control unit 118.

Measuring unit 116 measures the time from the shilling to the non-operating state to the shifting to another state (that is, the non-operating time). More specifically, measuring unit 116 starts measuring the non-operating time based on the shifting to the non-operating state and finishes measuring the non-operating time at the point of time when the non-operating state shifts to another state. Measuring unit 116 outputs the measured non-operating time to temperature control unit 118.

Temperature control unit 118 allows fixing device 20 to execute a high heat storage process when the state of image forming apparatus 100 is a waiting state and the number of times of printing output from count unit 114 is within a predetermined number of times (for example, once). Alternatively, when the state of image forming apparatus 100 is a waiting state and the non-operating time output from measuring unit 116 is equal to or longer than a predetermined time, temperature control unit 118 allows fixing device 20 to execute a high heat storage process.

Preferably, temperature control unit 118 allows fixing device 20 to execute a low heat storage process, irrespective of the number of times of printing and the non-operating time, when the temperature at the start of a warm-up is equal to or lower than a predetermined temperature. When a print instruction is accepted during a high heat storage process, temperature control unit 118 stops the high heat storage process.

[Control Structure of Image Forming Apparatus 100]

Figure 5:
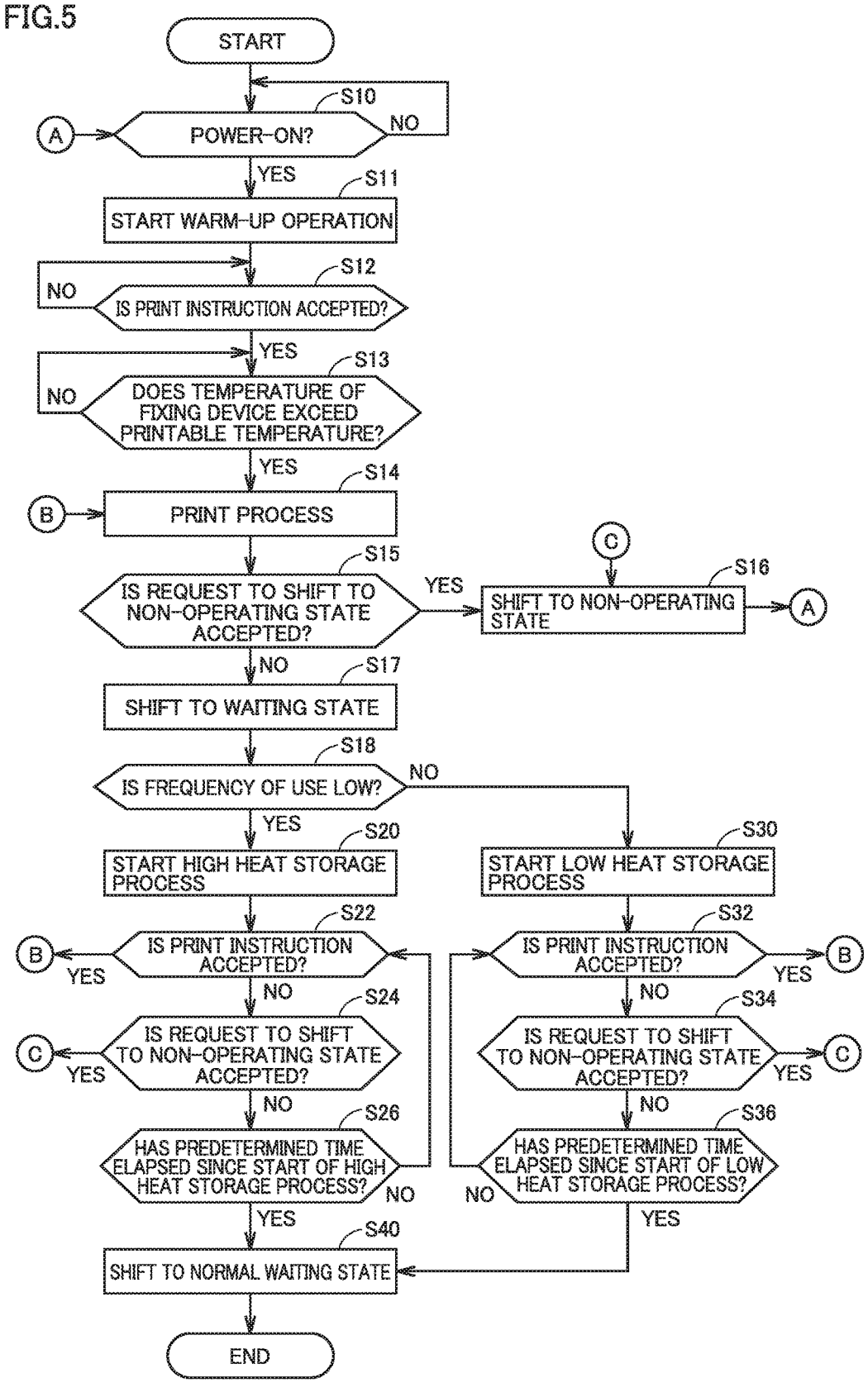
FIG. 5 is a flowchart illustrating part of the processing executed by the image forming apparatus according to an embodiment.

Referring to FIG. 5, the control structure of image forming apparatus 100 will be described. FIG. 5 is a flowchart illustrating part of the processing performed by image forming apparatus 100. The processing in FIG. 5 is implemented by, for example, control device 18 serving as a CPU (Central Processing Unit) executing a program. In another aspect, part or the whole of the processing in FIG. 5 may be implemented by circuit elements or other hardware.

In step S10, control device 18 determines whether the power is turned on. If it is determined that the power is turned on YES in step S10), control device 18 switches the control to step S12. If not (NO in step S10), control device 18 executes the processing in step S10 again.

In step S11, control device 18 serves as execution unit 110 (see FIG. 4) to start a warm-up of fixing device 20. Heating unit 30 (see FIG. 1) of fixing device 20 (see FIG. 1) is thus heated up to a printable temperature.

In step S12, control device 18 determines whether a print instruction is accepted. If it is determined that a print instruction is accepted (YES in step S12), control device 18 switches the control to step S13. If not (NO in step S12), control device 18 executes the processing in step S12 again.

In step S13, control device 18 determines whether the temperature of heating unit 30 of fixing device 20 exceeds a printable temperature. If it is determined that the temperature of heating unit 30 of fixing device 20 exceeds a printable temperature (YES in step S13), control device 18 switches the control to step S14. If not (NO in step S13), control device 18 executes the processing in step S13 again.

In step S14, control device 18 executes a print process and serves as count unit 114 (see FIG. 4) to count up the number of times of printing. When the print process is finished, control device 18 shifts the state of image forming apparatus 100 from the operating state to a waiting state.

In step S15, control device 18 determines whether a request to shift to the non-operating state is accepted. The request to shift is issued, for example, when a print instruction is not accepted for a predetermined time or longer. If it is determined that a request to shift to the non-operating state is accepted (YES in step S15), control device 18 switches the control to step S16. If not (NO in step S15), control device 18 switches the control to step S17.

In step S18, control device 18 determines whether image forming apparatus 100 is in a situation in which the frequency of use is low. As an example, when the number of times of printing since power-on is equal to or smaller than a predetermined number of times, control device 18 determines that image forming apparatus 100 is in a situation in which the frequency of use is low. Alternatively, when the non-operating time is equal to or longer than a predetermined time, image forming apparatus 100 determines that image forming apparatus 100 is in a situation in which the frequency of use is low. If it is determined that image forming apparatus 100 is in a situation in which the frequency of use is low (YES in step S18), control device 18 switches the control to step S20. If not (NO in step S18), control device 18 switches the control to step S30.

In step S20, control device 18 serves as temperature control unit 118 see FIG. 4) to allow fixing device 20 to execute a high heat storage process.

In step S22, control device 18 determines whether a print instruction is accepted. If it is determined that a print instruction is accepted (YES in step S22), control device 18 returns the control to step S14. If not (NO in step S22), control device 18 switches the control to step S24.

In step S24, control device 18 determines whether a request to shift to the non-operating state is accepted. If it is determined that a request to shift is accepted (YES in step S24), control device 18 switches the control to step S16. If not (NO in step S24), control device 18 switches the control to step S26.

In step S26, control device 18 serves as temperature control unit 118 to determine whether a predetermined time has elapsed since the high heat storage process started. That is, control device 18 determines whether the temperature of heating unit 30 reaches the target temperature in the high heat storage process. If it is determined that a predetermined time has elapsed since the high heat storage process started (YES in step S26), control device 18 switches the control to step S40. If not (NO in step S26), control device 18 returns the control to step S22.

In step S30, control device 18 serves as temperature control unit 118 to allow fixing device 20 to execute a low heat storage process. The low heat storage process in step S30 may not necessarily be executed. In this case, the control switches to step S32 without passing through step S18 to step S30.

In step S32, control device 18 determines whether a print instruction is accepted. If it is determined that a print instruction is accepted (YES in step S32), control device 18 returns the control to step S14. If not (NO in step S32), control device 18 switches the control to step S34.

In step S34, control device 18 determines whether a request to shift to the non-operating state is accepted. If it is determined that a request to shift to the non-operating state is accepted (YES in step S34), control device 18 switches the control to step S16. If not (NO in step S34), control device 18 switches the control to step S36.

In step S36, control device 18 serves as temperature control unit 118 to determine whether a predetermined time has elapsed since the low heat storage process started. That is, control device 18 determines whether the temperature of heating unit 30 reaches the target temperature in the low heat storage process. If it is determined that a predetermined time has elapsed since the low heat storage process started (YES in step S36), control device 18 switches the control to step S40. If not (NO in step S36), control device 18 returns the control to step S32.

In step S40, control device 18 shifts the state of image forming apparatus 100 to the normal waiting state.

[Hardware Configuration of Image Forming Apparatus 100]

Figure 6:
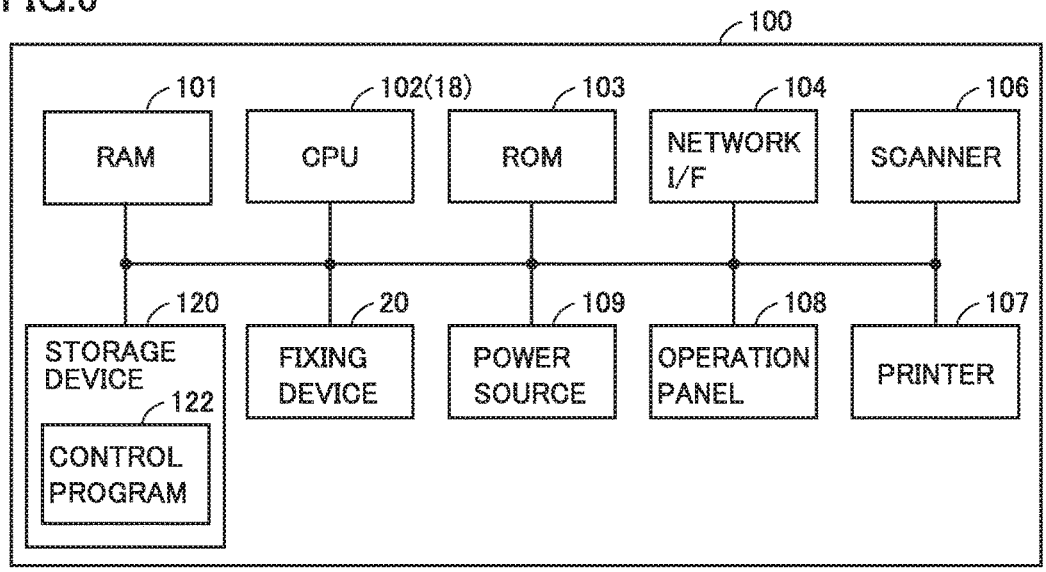
FIG. 6 is a block diagram showing a main hardware configuration of the image forming apparatus according to an embodiment.

Referring to FIG. 6, an exemplary hardware configuration of image forming apparatus 100 will now be described. FIG. 6 is a block diagram showing a main hardware configuration of image forming apparatus 100. As shown in FIG. 6, image forming apparatus 100 includes a ROM (Read Only Memory) 101, a CPU 102, a RAM (Random Access Memory) 103, a network I/F (interface) 104, a scanner 106, a printer 107, an operation panel 108, and a storage device 120.

ROM 101 stores, for example, a control program executed in image forming apparatus 100. CPU 102 is control device 18 described above. CPU 102 executes a variety of programs such as the control program for image forming apparatus 100 to control the operation of image forming apparatus 100, RAM 103 functions as a working memory to temporarily store a variety of data necessary for executing the control program.

Network I/F 104 is connected with, for example, an antenna (not shown). Image forming apparatus 100 exchanges data with other communication equipment through the antenna. Other communication equipment includes, for example, mobile communication terminals such as smartphones, and servers. Image forming apparatus 100 may be configured to download a control program 122 according to the present embodiment from a server through the antenna.

Scanner 106 optically scans an original set on image forming apparatus 100 to generate image data of the original.

Printer 107 converts image data read by scanner 106 or print data transmitted from other communication equipment into data fix printing, for example, by electrophotography, and prints an image of a document or other data based on the converted data.

Operation panel 108 is configured as a touch panel to accept a touch operation on image forming apparatus 100. As an example, operation panel 108 includes a display panel and a touch sensor superimposed on the display panel. Operation panel 108 accepts, for example, a setting operation related to control program 122 and a print instruction.

A power source 109 supplies power to various devices in image forming apparatus 100 based on the power button (not shown) of image forming apparatus 100 being pressed.

Storage device 120 is, for example a storage medium such as a hard disk and an external storage device. Storage device 120 stores, for example, control program 122 for implementing the processing according to the present embodiment.

Control program 122 according to the present embodiment may not be provided in the form of a single program but may be built in part of any given program. In this case, the processing according to the present embodiment is implemented in cooperation with any given program. Even such a program not including some modules does not depart from the scope of the program according to the present embodiment. Some or the whole of the functions provided by control program 122 according to the present embodiment may be implemented by dedicated hardware. Image forming apparatus 100 may be configured in the form of cloud service such that at least one server implements the processing according to the present embodiment.

[Fixing Device 20]

(Structure of Fixing Device 20)

Figure 7:
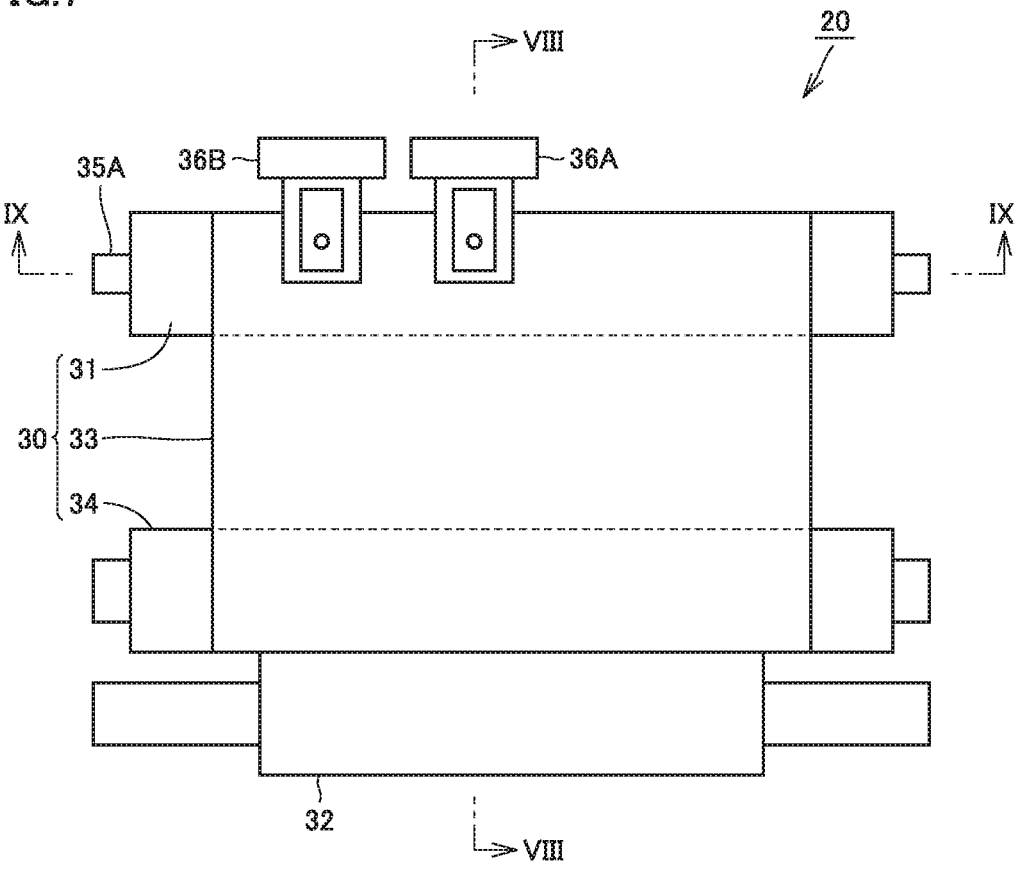
FIG. 7 is a plan view of the fixing device.
Figure 8:
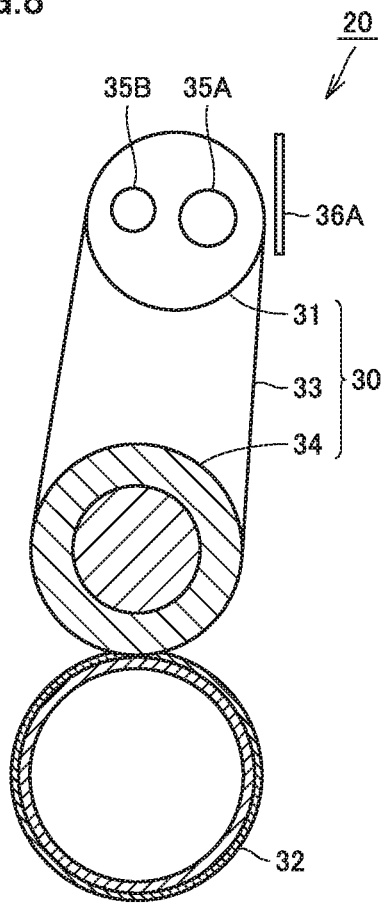
FIG. 8 is a cross-sectional view along the line in FIG. 7.
Figure 9:
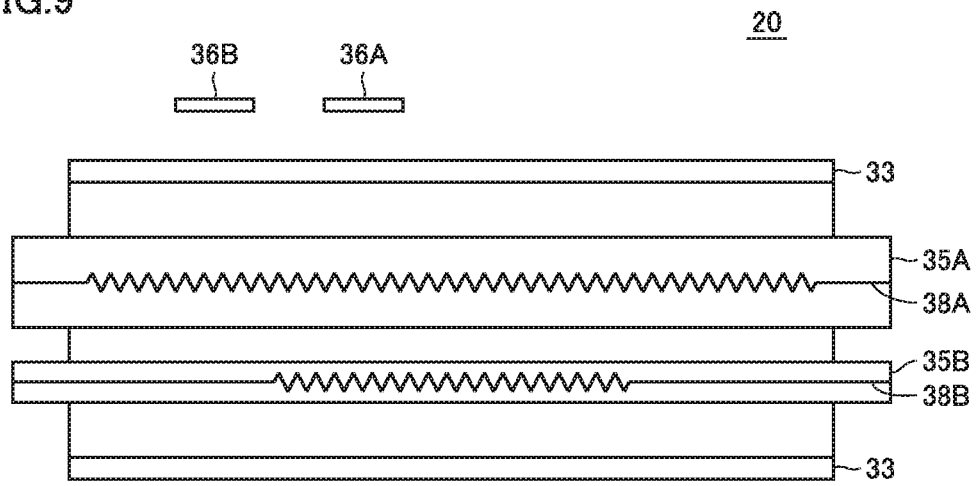
FIG. 9 is a cross-sectional view along the line IX-IX in FIG. 7.

Referring to FIG. 7 to FIG. 9, the structure of fixing device 20 shown in FIG. 1 will be described. FIG. 7 is a plan view of fixing device 20. FIG. 8 is a cross-sectional view along the line in FIG. 7. FIG. 9 is a cross-sectional view along the line IX-IX in FIG. 7.

As shown in FIG. 7 to FIG. 9, fixing device 20 includes a heating unit 30, a pressing roller 32, and thermistors 36A, 36B. Heating unit 30 includes a heating roller 31, a fixing belt 33, and a fixing roller 34. Heating roller 31 has a long heater 35A and a short heater 35B inside thereof.

Heating roller 31 is formed of a cylindrical core made of, for example, aluminum. The thickness of the core is, for example, 0.6 mm. The core has a resin layer, for example, made of PTFE (polytetrafluoroethylene) on its outer circumferential surface. The thickness of PTFE is, for example, 15 μm. The outer diameter of heating unit 30 is, for example, 25 mm. The longitudinal length of heating unit 3 for example, 330 mm.

Pressing roller 32 is formed of a cylindrical core made of, for example, aluminum. The outer diameter of pressing roller 32 is, for example, 35 mm. The thickness of the core is, for example, 2 mm. The core has a rubber layer and a resin layer made of for example, PEA (perfluoro alkoxyl alkane) on its outer circumferential surface. The thickness of the rubber layer is, for example, 2 mm. The thickness of PEA is, for example, 30 μm.

Fixing belt 33 is stretched between heating roller 31 and fixing roller 34 and rotates in synchronization with heating roller 31 and fixing roller 34. Fixing belt 33 is formed of, for example, polyimide, a rubber layer, and PEA. The outer diameter of fixing belt 33 is, for example, 60 mm. The thickness of polyimide is, for example, 70 μm. The thickness of the rubber layer is, for example, 200 μm.

Fixing roller 34 is pressed against fixing belt 33. Fixing roller 34 is formed of a cylindrical core made of, for example, iron. The outer diameter of fixing roller 34 is, for example, 30 mm. The outer diameter of the core is, for example, 18 mm. The core has a rubber layer and a sponge layer on its outer circumferential surface. The thickness of the rubber layer is, for example, 4 mm. The thickness of the sponge layer is, for example, 2 mm.

Long heater 35A is, for example, a halogen lamp heater. The power rating of long heater 35A is, for example, 999 W (watts). The luminous intensity distribution of long heater 35A is, for example, 80% or more. Long heater 35A has a heat source 38A inside thereof. The length of the part of heat source 38A that generates heat is, for example, 290 mm. The amount of heating can be changed with power supplied to heat source 38A. In place of long heater 35A, a resistance heating element or an induction heater may be provided.

Short heater 35B is, for example, a halogen lamp heater. The power rating of short heater 35B is, for example, 790 W. The luminous intensity distribution of short heater 35B is, for example, 80% or more. Short heater 35B has a heat source 38B inside thereof. The length of the part of heat source 38B that generates heat is, for example, 180 mm. The amount of heating can be changed with power supplied to heat source 38B. In place of short heater 35B, a resistance heating element or an induction heater may be provided.

Thermistors 36A, 36B are temperature sensors for detecting the temperature of fixing belt 33. Thermistors 36A, 36B are disposed to face fixing belt 33 and are disposed not in contact with fixing belt 33. Thermistor 36A is disposed, for example, at a position 70 mm away from the central paper-passage reference of fixing belt 33 in the longitudinal direction. Thermistor 36B is disposed, for example, at a position 135 mm away from the central paper-passage reference of fixing belt 33 in the longitudinal direction.

(Operation of Fixing Device 20 in Printing)

Referring now to FIG. 7 to FIG. 9, the operation of fixing device 20 in printing will be described.

Equation (1) below is to be satisfied:

$$TA1 = A \times T1 \quad (1)$$

where T1 is the detected temperature of thermistor 36A; A is a correction coefficient for temperature adjustment; and TA1 is the corrected temperature for temperature adjustment. Corrected temperature TA1 is adjusted by turning on/off heat sources 38A, 38B.

The operation of setting the surfaces of fixing belt 33 and pressing roller 32 to a printable temperature after image forming apparatus 100 is powered on is referred to as a warm-up, and the time required for a warm-up is referred to as a warm-up time. The warm-up is executed, for example, during a power reset, during recovery from a jam, during closing of the cover, or during recovery from the sleep mode.

During a warm-up, fixing device 20 drives heating unit 30 to increase the temperature of heating unit 30 up to a printable temperature (that is, a target temperature). The target temperature is, for example, 155° C. Fixing device 20 controls long heater 35A and short heater 35B with input of corrected temperature TA1.

Fringe forming apparatus 100 transmits driving force to a drive gear (not shown) to rotate pressing roller 32 and drives the rotation of heating unit 30, fixing belt 33, and fixing roller 34. Heat from heating unit 30 is thus transferred to the surfaces of fixing belt 33 and pressing roller 32. The linear velocity of fixing device 20 at this point of time (the velocity at which a print material passes through fixing device 20) is, for example, 135 mm/s. The heating by heating unit 30 and the rotation of heating unit 30 increases the temperature of the surfaces of fixing belt 33 and pressing roller 32 up to a printable temperature.

When corrected temperature TA1 obtained by multiplying temperature T1 detected by thermistor 36A by correction coefficient A reaches a printable temperature, fixing device 20 outputs a signal (ready) indicating that print is ready to image forming apparatus 100. The signal is output, for example based on corrected temperature TA1 reaching 135° C. When a print signal is not accepted, image forming apparatus 100 enters a waiting state. When a print signal is accepted, image forming apparatus 100 starts printing. The target temperature in a waiting state is, for example, 155° C. to 150° C. The target temperature is controlled by the turning on/off of long heater 35A and short heater 35B.

When regular paper is printed in full color, the linear velocity of the fixing device is, for example, 135 mm/s. The target temperature in this case is, for example, 155° C. to 170° C., and the turning on/off of the long heater 35A or short heater 35B is controlled with input of corrected temperature TA1.

More specifically, when the value obtained by subtracting corrected temperature TB1 for heat source selection from temperature T2 detected by thermistor 36B is equal to or greater than a predetermined value, image forming apparatus 100 determines that the temperature at an end of fixing belt 33 is high, and controls the turning on/off of short heater 35B located at the end. When the value obtained by subtracting corrected temperature TB1 for heat source selection from temperature T2 detected by thermistor 36B is less than a predetermined value, image forming apparatus 100 controls the turning on/off of long heater 35A.

Taking a print process for B4-size paper as an example, the temperature control of fixing device 20 will be further described.

The temperature of thermistor 36B at the end is not high before paper passes through fixing device 20. Image forming apparatus 100 therefore controls long heater 35A and turns on/off long heater 35A with input of corrected temperature TA1. For example, when the luminous intensity distribution of long heater 35A is 80% or more, the length of long heater 35A is 290 mm, and the width of B4 paper is 257 mm, the width of paper passage is larger than the width of heating, and the heated range includes a paper passage region and a non-paper passage region. In this case, heat is not lost by paper in the non-paper passage region, so that the temperature of the non-paper passage region gradually increases compared with the temperature of the paper passage region.

Assume that thermistor 36B is disposed, for example, at a position 135 mm away from the central paper-passage reference of fixing belt 33 in the longitudinal direction and that an end of the paper passage region is located 118.5 mm from the central paper-passage reference in the same direction. If the value obtained by subtracting corrected temperature TB1 from temperature T2 detected by thermistor 36B is equal to or greater than a predetermined value, image forming apparatus 100 determines that the temperature at the end of fixing belt 33 is high, and switches the on/off control from long heater 35A, to short heater 35B.

CONCLUSION

As described above, image forming apparatus 100 executes a high heat storage process in a waiting state, when it is determined that the frequency of use is low. Image forming apparatus 100 determines that the frequency of use is low, by determining whether the waiting state is subsequent to execution of printing a predetermined number of times since power-on. Alternatively, image forming apparatus 100 determines whether the waiting state is subsequent to the non-operating state that continues for a predetermined time (for example, one hour) or longer.

In this manner, image forming apparatus 100 executes a high heat storage process in the waiting state in a situation in which the frequency of use is low, thereby increasing the temperature of heating unit 30 higher than in other waiting states. This processing reduces a warm-up time in the next printing, resulting in a shorter printing time. This reduces the waiting time for the user in printing and improves the convenience of image forming apparatus 100.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus having an operating state and a non-operating state with power consumption smaller than power consumption in the operating state, comprising:

a fixing device including a rotatable heating unit and a rotatable pressing unit pressed against the heating unit, the fixing device fixing a toner image on a print material passing through between the heating unit and the pressing unit by heating the heating unit;

an execution unit for executing a warm-up to heat the heating unit up to a predetermined temperature that allows the toner image to be fixed on the print material, when the image forming apparatus is powered on or when the image forming apparatus shifts from the non-operating state to the operating state; and a temperature control unit for maintaining a waiting state after completion of the warm-up or after completion of printing, wherein the temperature control unit executes a process of increasing a temperature of the heating unit higher in a waiting state when printing is executed less than a predetermined number of times since the image forming apparatus is powered on or in a waiting state after the non-operating state continues for a predetermined time or longer, than in any other waiting state.

2. The image forming apparatus according to claim 1, wherein the fixing device includes a sensor for detecting a temperature of the heating unit, and the temperature control unit does not execute the process when a temperature of the heating unit at start of the warm-up is a predetermined temperature or higher.

3. The image forming apparatus according to claim 1, wherein the temperature control unit adjusts a temperature of the heating unit by changing at least one of a target temperature set for the heating unit and a rotation time of the heating unit.

4. The image forming apparatus according to claim 3, wherein the temperature control unit:

sets the target temperature to a first temperature and sets the rotation time to a first time, in the waiting state after printing is executed the predetermined number of times or in the waiting state after the non-operating state continues for the predetermined time or longer, and sets the target temperature to a second temperature lower than the first temperature and sets the rotation time to a second time shorter than the first time, in the other waiting state.

5. The image forming apparatus according to claim 1, wherein the temperature control unit stops the process when a print instruction is accepted during execution of the process.

6. A control method for an image forming apparatus having an operating state and a non-operating state with power consumption smaller than power consumption in the operating state, the image forming apparatus comprising a fixing device including a rotatable heating unit and a rotatable pressing unit pressed against the heating unit, the fixing device fixing a toner image on a print material passing through between the heating unit and the pressing unit by heating the heating unit the control method comprising:

executing a warm-up to heat the heating unit up to a predetermined temperature that allows the toner image to be fixed on the print material, when the image forming apparatus is powered on or when the image forming apparatus shifts from the non-operating state to the operating state;

maintaining a waiting state after completion of the warm-up or after completion of printing; and executing a process of increasing a temperature of the heating unit higher in a waiting state when printing is executed less than a predetermined number of times since the image forming apparatus is powered on or in a waiting state after the non-operating state continues for a predetermined time or longer, than in any other waiting state.

7. The control method according to claim 6, wherein the fixing device includes a sensor for detecting a temperature of the heating unit, and the process is not executed when a temperature of the heating unit at start of the warm-up is a predetermined temperature or higher.

8. The control method according to claim 6, wherein the process includes adjusting a temperature of the heating unit by changing at least one of a target temperature set for the heating unit and a rotation time of the heating unit.

9. The control method according to claim 8, wherein the process includes:

setting the target temperature to a first temperature and setting the rotation time to a first time, in the waiting state after printing is executed the predetermined number of times or in the waiting state after the non-operating state continues for the predetermined time or longer; and setting the target temperature to a second temperature lower than the first temperature and setting the rotation time to a second time shorter than the first time, in the other waiting state.

10. The control method according to claim 6, further comprising stopping the process when a print instruction is accepted during execution of the process.

11. A non-transitory storage medium encoded with a control program for an image forming apparatus having an operating state and a non-operating state with power consumption smaller than power consumption in the operating state, the image forming apparatus comprising a fixing device including a rotatable heating unit and a rotatable pressing unit pressed against the heating unit, the fixing device fixing a toner image on a print material passing through between the heating unit and the pressing unit by heating the heating unit the control program causing the image forming apparatus to execute:

executing a warm-up to heat the heating unit up to a predetermined temperature that allows the toner image to be fixed on the print material, when the image forming apparatus is powered on or when the image forming apparatus shifts from the non-operating state to the operating state;

maintaining a waiting state after completion of the warm-up or after completion of printing; and executing a process of increasing a temperature of the heating unit higher in a waiting state when printing is executed less than a predetermined number of times since the image forming apparatus is powered on or in a waiting state after the non-operating state continues for a predetermined time or longer, than in any other waiting state.

12. The non-transitory storage medium according to claim 11, wherein the fixing device includes a sensor for detecting a temperature of the heating unit, and the process is not executed when a temperature of the heating unit at start of the warm-up is a predetermined temperature or higher.

13. The non-transitory storage medium according to claim 11, wherein the process includes adjusting a temperature of the heating unit by changing at least one of a target temperature set for the heating unit and a rotation time of the heating unit.

14. The non-transitory storage medium according to claim 13, wherein the process includes:

setting the target temperature to a first temperature and setting the rotation time to a first time, in the waiting state after printing is executed the predetermined number of times or in the waiting state after the non-operating state continues for the predetermined time or longer; and setting the target temperature to a second temperature lower than the first temperature and setting the rotation time to a second time shorter than the first time, in the other waiting state.

15. The non-transitory storage medium according to claim 11, wherein the control program causes the image forming apparatus to further execute: stopping the process when a print instruction is accepted during execution of the process.

* * * * *